US010752477B2

(12) United States Patent
Matsushita

(10) Patent No.: US 10,752,477 B2
(45) Date of Patent: Aug. 25, 2020

(54) CONTROL DEVICE OF HYDRAULIC WINCH

(71) Applicant: SUMITOMO HEAVY INDUSTRIES CONSTRUCTION CRANES CO., LTD., Tokyo (JP)

(72) Inventor: Tatsuya Matsushita, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 0 days.

(21) Appl. No.: 16/298,668

(22) Filed: Mar. 11, 2019

(65) Prior Publication Data

US 2019/0284028 A1 Sep. 19, 2019

(30) Foreign Application Priority Data

Mar. 16, 2018 (JP) ..... 2018-049180

(51) Int. Cl.
*B66D 1/08* (2006.01)
*B66D 1/44* (2006.01)
*B66D 5/26* (2006.01)

(52) U.S. Cl.
CPC ..... *B66D 1/08* (2013.01); *B66D 1/44* (2013.01); *B66D 5/26* (2013.01); *B66D 2700/0133* (2013.01); *B66D 2700/035* (2013.01)

(58) Field of Classification Search
CPC ... B66D 1/08; B66D 1/44; B66D 5/26; B66D 2700/0133; B66D 2700/035
See application file for complete search history.

(56) References Cited

U.S. PATENT DOCUMENTS

RE20,551 E * 11/1937 Rouse ..... B66D 1/48 114/268
2,309,004 A * 1/1943 Olmstead ..... B66D 1/08 242/397.3

(Continued)

FOREIGN PATENT DOCUMENTS

JP 2009-155022 A 7/2009
JP 2009155022 A * 7/2009

(Continued)

OTHER PUBLICATIONS

Search Report issued in European Patent Application No. 19159935.6, dated Oct. 2, 2019.

*Primary Examiner* — Michael E Gallion
(74) *Attorney, Agent, or Firm* — Michael Best & Friedrich LLP

(57) ABSTRACT

A control device of a hydraulic winch includes an engine, a hydraulic pump, a hydraulic motor driving a winch drum, a winch manipulating member, an engine control unit controlling a rotation speed of the engine, a winch load detector detecting a load applied to the winch drum, and a motor capacity control unit controlling a motor capacity of the hydraulic motor so as to decrease a motor capacity of the hydraulic motor in a fuel-saving operation mode to a motor capacity which is smaller than a motor capacity of the hydraulic motor in a normal operation mode. The engine control unit sets an upper limit value of the rotation speed of the engine in the fuel-saving operation mode to a value which is lower than a maximum rotation speed of the engine in the normal operation mode and corresponds to the load detected by the winch load detector.

7 Claims, 11 Drawing Sheets

(56) References Cited

U.S. PATENT DOCUMENTS

| | | | | | |
|---|---|---|---|---|---|
| 4,317,466 | A * | 3/1982 | Ikeda | B66D 1/44 | 137/115.13 |
| 4,686,828 | A * | 8/1987 | Rosman | B66D 1/08 | 212/250 |
| 5,176,364 | A * | 1/1993 | Bell | B66D 1/08 | 254/291 |
| 6,371,447 | B1 * | 4/2002 | Imanishi | B66D 1/44 | 254/361 |
| 6,648,303 | B1 * | 11/2003 | Nishimoto | B66D 1/08 | 254/361 |
| 7,775,383 | B2 * | 8/2010 | Ueki | B66D 1/52 | 212/308 |
| 8,930,094 | B2 * | 1/2015 | Torii | B66C 13/20 | 701/123 |
| 2006/0156713 | A1 * | 7/2006 | Kadlicko | F15B 21/14 | 60/413 |
| 2012/0260643 | A1 * | 10/2012 | Kadlicko | F15B 11/055 | 60/327 |
| 2012/0260644 | A1 * | 10/2012 | Kadlicko | F15B 1/02 | 60/413 |
| 2014/0338317 | A1 * | 11/2014 | Uemura | B66C 23/44 | 60/329 |

FOREIGN PATENT DOCUMENTS

| | | | |
|---|---|---|---|
| JP | 2013-209193 | A | 10/2013 |
| JP | 5863561 | B2 | 2/2016 |

* cited by examiner

| | MOTOR CAPACITY Qm | PUMP CAPACITY Qp |
|---|---|---|
| NORMAL OPERATION MODE | Qm1 TO Qm2 (HERE, Qm1 > Qm2) | Qp1 TO Qp2 (HERE, Qp1 > Qp2) |
| FUEL-SAVING OPERATION MODE | Qm1 TO Qm3 (HERE, Qm2 > Qm3) | Qp3 TO Qp1 (HERE, Qp3 > Qp1) |

CONTROL DEVICE OF HYDRAULIC WINCH

RELATED APPLICATIONS

Priority is claimed to Japanese Patent Application No. 2018-049180, filed Mar. 16, 2018, the entire content of which is incorporated herein by reference.

BACKGROUND

Technical Field

Certain embodiment of the present invention relates to a control device of a hydraulic winch applied to a crane.

Description of Related Art

For Example, as a background of the present technical field, a control device of a hydraulic winch described in the related art includes condition determination means for determining that a fuel-saving high-speed operation condition is satisfied if a winch manipulating member is manipulated from a low-speed hoisting/lowering manipulation position toward a high-speed hoisting/lowering manipulation position when an engine rotation speed is equal to or less than a predetermined rotation speed and a line pull is equal to or less than a predetermined value and motor capacity control means for decreasing a motor capacity of a hydraulic motor to control the motor capacity to a minimum capacity if the condition determination means determines that the fuel-saving high-speed operation condition is satisfied. In addition, if the condition determination means determines that the fuel-saving high-speed operation condition is satisfied, engine control means sets an upper limit value of the engine rotation speed to a predetermined rotation speed which is smaller than a maximum rotation speed. In the related art, the hydraulic motor is rotationally driven at a high speed in a state where the engine rotation speed decreases, and thus, fuel consumption is improved and noise decreases.

SUMMARY

According to an embodiment of the present invention, there is provided a control device of a hydraulic winch which has a normal operation mode and a fuel-saving operation mode in which a fuel-saving operation is performed unlike in the normal operation mode, is applied to a crane for hoisting/lowering a rope by a winch drum, and controls a rotation of the winch drum, the device including: an engine; a variable capacity hydraulic pump which is driven by the engine; a variable capacity hydraulic motor which is rotated by pressure oil from the hydraulic pump to drive the winch drum; a winch manipulating member configured to output hoisting/lowering commands for hoisting/lowering the rope; an engine control unit configured to control a rotation speed of the engine to be in a range from a minimum rotation speed to a maximum rotation speed according to the hoisting/lowering commands from the winch manipulating member; a winch load detector configured to detect a load applied to the winch drum; and a motor capacity control unit configured to control a motor capacity of the hydraulic motor so as to decrease a motor capacity of the hydraulic motor in the fuel-saving operation mode to a motor capacity which is smaller than a motor capacity of the hydraulic motor in the normal operation mode, in which the engine control unit sets an upper limit value of the rotation speed of the engine in the fuel-saving operation mode to a value which is lower than the maximum rotation speed of the engine in the normal operation mode and corresponds to the load detected by the winch load detector.

DETAILED DESCRIPTION

In the related art, in a case where a fuel-saving high-speed operation condition is satisfied, an upper limit value of an engine rotation speed is set to a predetermined rotation speed which is smaller than a maximum rotation speed. However, the predetermined rotation speed is a value which is determined in advance, that is, is a fixed value, and thus, there is a room for improvement in terms of fuel consumption when a crane is operated.

It is desirable to provide a control device of a hydraulic winch capable of improving fuel consumption when the crane is operated.

According to the present invention, it is possible to improve fuel consumption when a crane is operated. In addition, problems, configuration, and effects other than those described above will be clarified from descriptions of the embodiment below.

Figure 1:
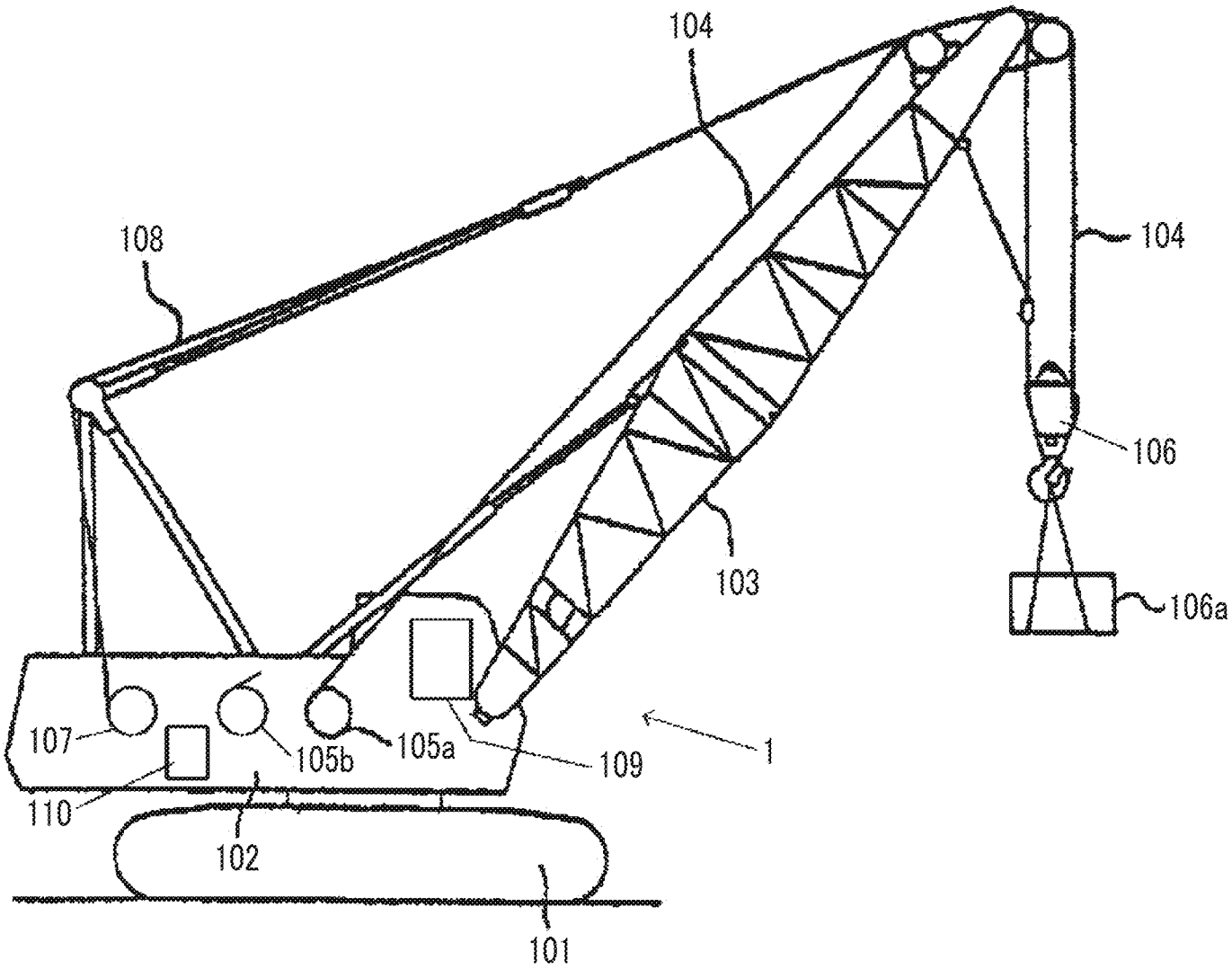
FIG. 1 is a side view of a crane on which a control device of a hydraulic winch according to the present embodiment is mounted.

Hereinafter, a crawler crane (hereinafter, simply referred to as a crane) on which a control device of a hydraulic winch according to an embodiment of the present invention is mounted will be described with reference to the drawings. FIG. 1 is an exterior side view of a crane 1 on which the control device of a hydraulic winch according to the present embodiment is mounted. As shown in FIG. 1, the crane 1 includes a traveling body 101 which includes a pair of crawlers, a turning body 102 which is turnably mounted on the traveling body 101, and a boom 103 which is supported by the turning body 102 so as to be raised or lowered. An engine 110 which is a power source of the crane 1 and three winch drums (front drum 105*a*, a rear drum 105*b*, and boom derricking drum 107) are mounted on the turning body 102.

A front drum wire rope (rope) 104 is hoisted or lowered by driving the front drum 105*a*, and thus, a suspended load 106*a* hung by a main hook 106 is lifted or lowered. In addition, in FIG. 1, descriptions of a rear drum wire rope which is hoisted or lowered by driving the rear drum 105*b* and an auxiliary hook which is lifted and lowered by this wire rope are omitted. A boom derricking rope 108 is hoisted or lowered by driving the boom derricking drum 107, and thus, the boom 103 is raised or lowered.

Figure 2:
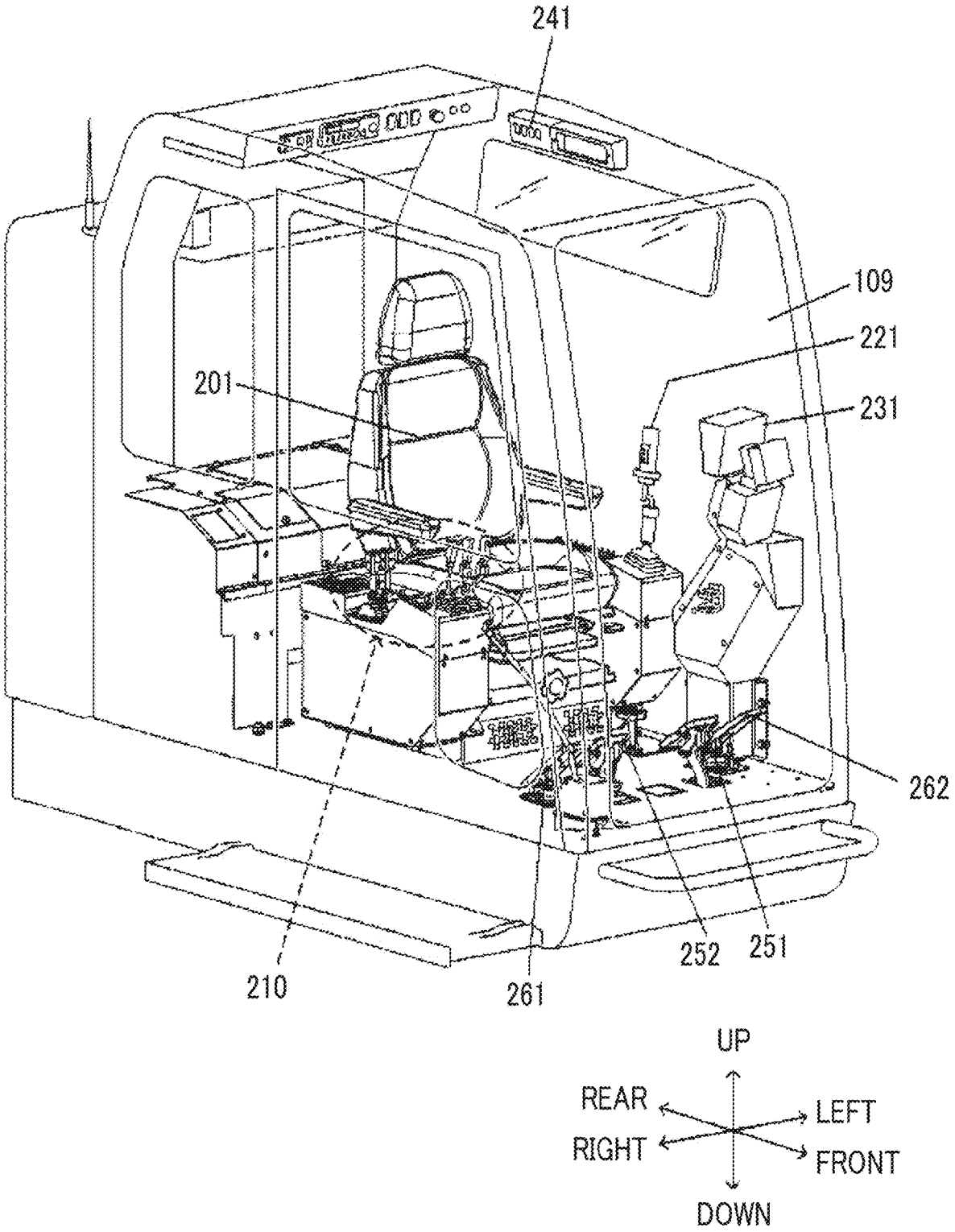
FIG. 2 is a perspective view showing the entire operator cab.

As shown in FIG. 1, an operator cab 109 is provided in the turning body 102. FIG. 2 is a perspective view showing the entire operator cab 109. The operator cab 109 includes a driver's seat 201 on which an operator sits, a right-side lever group 210 which is manipulated by the operator sitting on the driver's seat 201 with the right hand, and a left-side lever (turning lever) 221 which is manipulated by the operator sitting on the driver's seat 201 with the left hand, are provided. A display device 231 is provided at the front left of the driver's seat 201 and a fuel-saving operation mode switch 241 is provided at the upper left of the operator cab 109.

A front drum brake pedal 251 for braking the front drum 105*a*, a rear drum brake pedal 252 for braking the rear drum 105*b*, an accelerator pedal 261 for increasing/decreasing the rotation speed of the engine 110, and a turning brake pedal 262 for braking the turning body 102 are provided on a floor of the operator cab 109.

Figure 3:
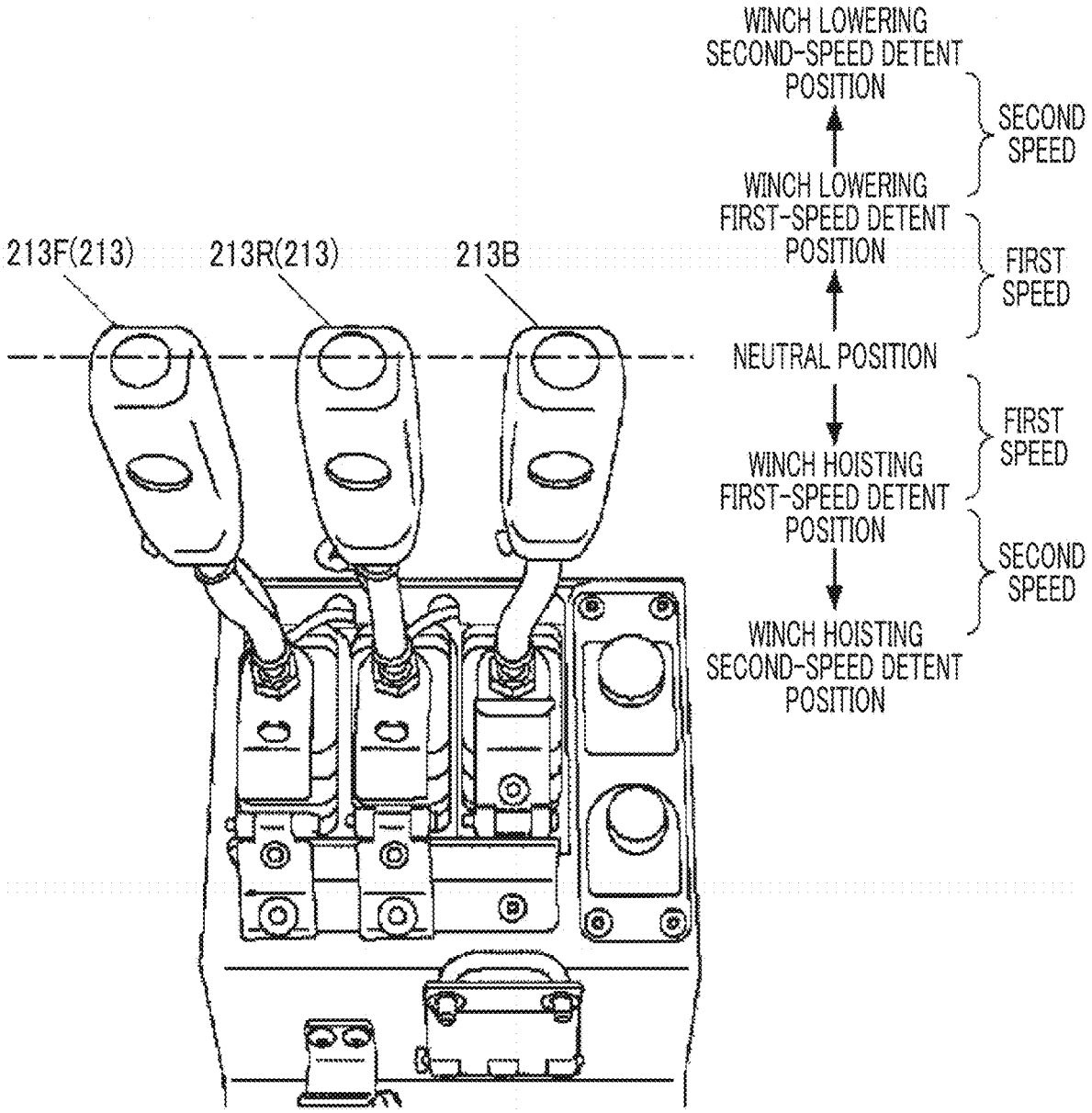
FIG. 3 is a view explaining a manipulation position of a winch manipulating lever.

The right-side lever group 210 includes a pair of traveling levers, that is, a traveling lever for driving a left crawler and a traveling lever for driving a right crawler, and as shown in FIG. 3, a front winch manipulating lever 213F, a rear winch manipulating lever 213R, and a boom derricking winch manipulating lever 213B. The traveling levers are manipulating levers for respectively driving the right crawler and the left crawler by being oscillated in a front-rear direction. The front winch manipulating lever 213F is a manipulating lever for driving the front drum 105*a* by being oscillated in the front-rear direction, and the rear winch manipulating lever 213R is a manipulating lever for driving the rear drum 105*b* by being oscillated in the front-rear direction. The boom derricking winch manipulating lever 213B is a manipulating lever for driving the boom derricking drum 107 by being oscillated in the front-rear direction.

With reference to FIG. 3, the manipulation positions of the front winch manipulating lever 213F and the rear winch manipulating lever 213R which are winch manipulating members will be described. When the front winch manipulating lever 213F is rotated by a predetermined angle forward in a vehicle from a neutral position, the front winch manipulating lever 213F is detent-locked by a well-known detent mechanism and is held at a winch lowering first-speed detent position. When the front winch manipulating lever 213F is rotated by a predetermined angle forward in the vehicle from the winch lowering first-speed detent position, the front winch manipulating lever 213F is detent-locked by the detent mechanism and is held at a winch lowering second-speed detent position. When the front winch manipulating lever 213F is rotated by a predetermined angle rearward in the vehicle from the neutral position, the front winch manipulating lever 213F is detent-locked by the detent mechanism and is held at a winch hoisting first-speed detent position. When the front winch manipulating lever 213F is rotated by a predetermined angle rearward in the vehicle from the winch hoisting first-speed detent position, the front winch manipulating lever 213F is detent-locked by the detent mechanism and is held at a winch hoisting second-speed detent position. Like the front winch manipulating lever 213F, the rear winch manipulating lever 213R is rotated forward in the vehicle from a neutral position, and thus, the rear winch manipulating lever 213R can be manipulated to the winch lowering first-speed detent position and the winch lowering second-speed detent position. In addition, the rear winch manipulating lever 213R is rotated rearward in the vehicle from the neutral position, and thus, the rear winch manipulating lever 213R can be manipulated to the winch hoisting first-speed detent position and the winch hoisting second-speed detent position.

If the front winch manipulating lever 213F is manipulated to the hoisting/lowering first-speed detent positions, a pilot pressure corresponding to low-speed hoisting/lowering commands for hoisting/lowering the hanging rope 104 of the main hook 106 at a low speed is output. If the front winch manipulating lever 213F is manipulated to the hoisting/lowering second-speed detent positions, a pilot pressure corresponding to high-speed hoisting/lowering commands for hoisting/lowering the hanging rope 104 of the main hook 106 at a high speed is output.

Figure 4:
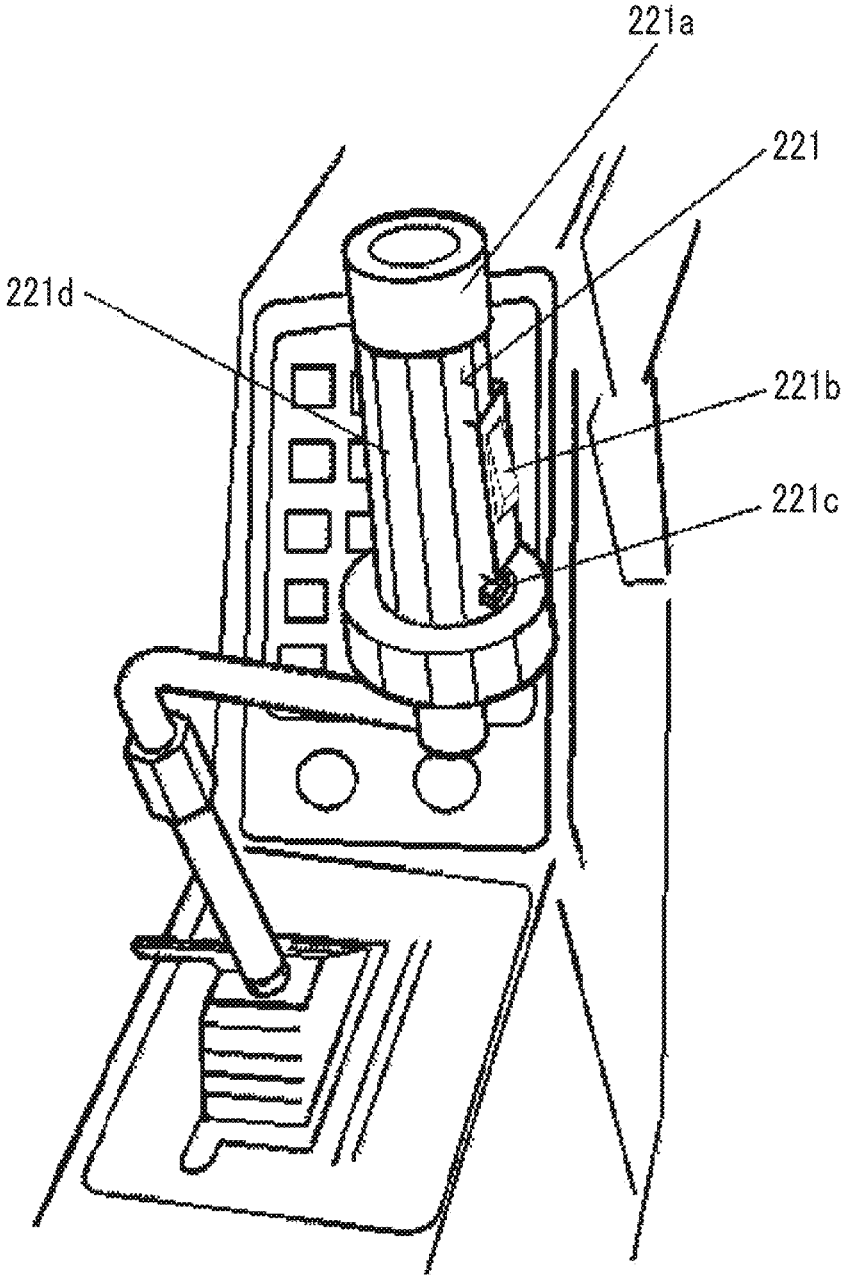
FIG. 4 is a view showing a turning lever.

The left-side lever shown in FIG. 2, that is, the turning lever 221 is a manipulating lever for turning the turning body 102 by being oscillated in the front-rear direction. As shown in FIG. 4, the turning lever 221 includes a holding portion 221*d* which is held by the operator sitting on the driver's seat 201. The turning lever 221 includes an accelerator grip 221*a*, a turning brake switch 221*b*, and an eco-switch 221*c*.

The accelerator grip 221*a* is a manipulating unit for increasing or decreasing the rotation speed of the engine 110 by being rotated in the clockwise direction or a counterclockwise direction in a state of being held by the left hand of the operator. In addition, as described later, an upper limit of the rotation speed of the engine 100 is restricted in the fuel-saving operation mode, and thus, even when the accelerator grip 221*a* rotates, the rotation speed of the engine 100 can increase to only the upper limit value. The turning brake switch 221*b* is a switch for selecting whether or not to apply turning brake which holds the turning body 102 such that the turning body 102 is not turned. The eco-switch 221*c* is provided at a lower end portion of the holding portion 221*d* of the turning lever 221 so as to manipulate the turning lever 221 in a state of holding the turning lever 221. Details of a function of the eco-switch 221*c* will be described later.

Figure 5:
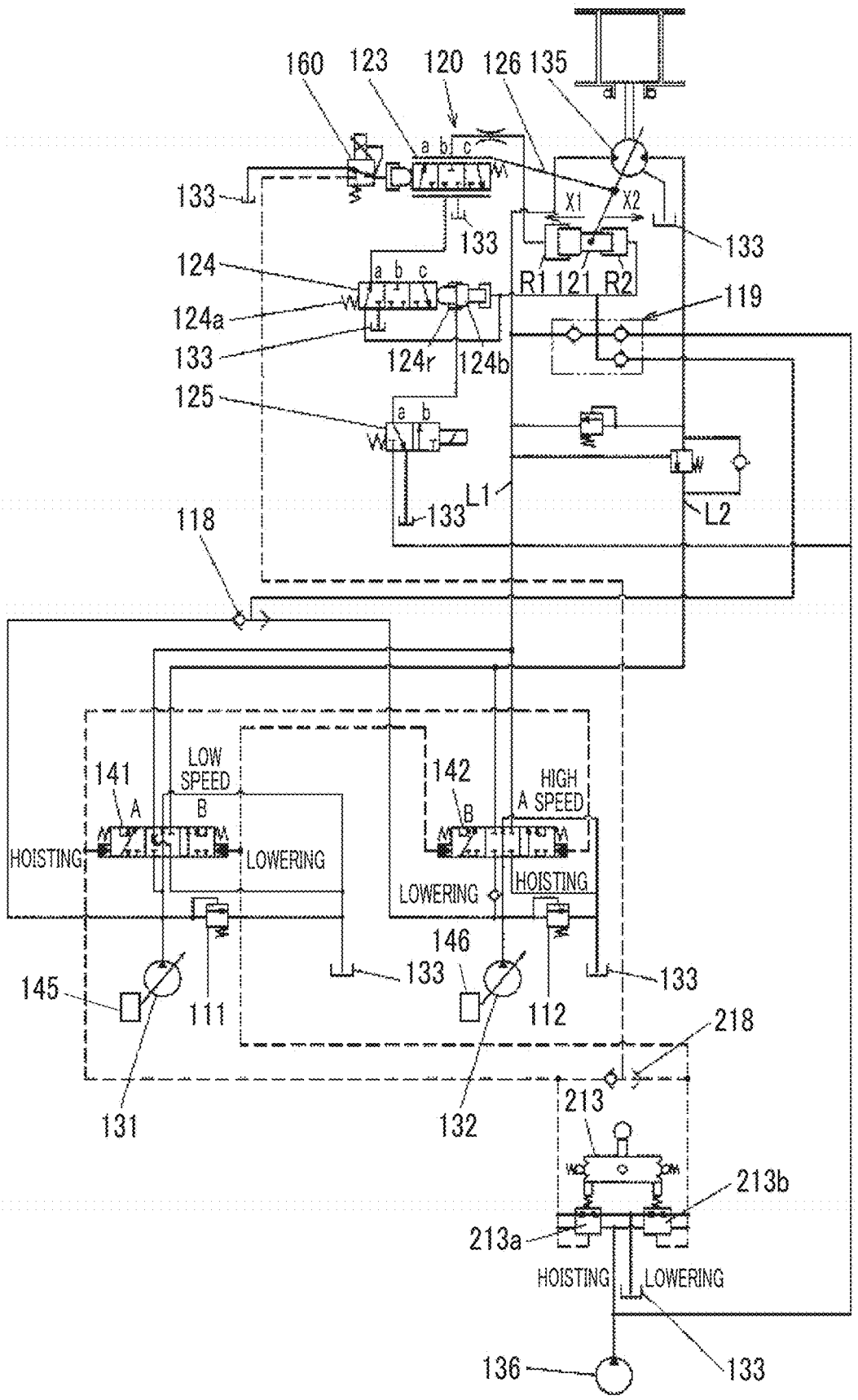
FIG. 5 is a diagram showing a schematic configuration of a hydraulic circuit of a winch.

FIG. 5 is a diagram showing a schematic configuration of a hydraulic circuit of the winch. The hydraulic circuit includes a first pump 131 and a second pump 132 which are driven by an engine (not shown), a pilot pump 136 which is driven by the engine (not shown), a hydraulic oil tank 133, and a variable capacity hydraulic motor 135 which is rotated by pressure oil discharged from the first pump 131 and the second pump 132. The hydraulic motor 135 is driven by the pressure oil supplied from the first pump 131 and the second pump 132 via a pair of main pipelines L1 and L2.

As the hydraulic motor 135 which is used to hoist/lower the hook attached to the hanging rope, there are a front winch motor for rotating the front drum 105*a* and a rear winch motor for rotating the rear drum 105*b*. For the sake of convenience, in FIG. 5, as the hydraulic motor 135 for driving a winch drum, the front winch motor is shown as a representative, and the rear winch motor similarly configured to the front winch motor and the hydraulic circuit for driving the rear winch motor are omitted.

Each of the first pump 131 and the second pump 132 is a variable capacity hydraulic pump, and tilting angles of the first pump 131 and the second pump 132 are tilt angle control units (pump capacity control units) 147*a* and 147*b* to control a pump capacity Qp. The tilt angle control unit 147*a* controls the tilting angle of the first pump 131 and includes a regulator 145, a solenoid proportional valve, or the like. Similarly, the tilt angle control unit 147*b* controls the tilting angle of the second pump 132 and includes a regulator 146, a solenoid proportional valve, or the like. Operations of the regulators 145 and 146 are controlled by a controller 150. That is, the controller 150 drives the solenoid proportional valves (not shown in FIG. 5) so as to adjust pilot pressures applied to the regulators 145 and 146, and thus, the operations of the regulators 145 and 146 are controlled (refer to FIG. 6). As a result, the pump capacity Qp of each of the first pump 131 and the second pump 132 is changed.

The hydraulic motor 135 is driven by the pressure oil from the first pump 131 and the second pump 132 whose flow is controlled by a first direction control valve (a valve for a low speed) 141 and a second direction control valve (a valve for a high speed) 142. At the time of the first speed, the pressure oil from only the first pump 131 is introduced to the hydraulic motor 135, and at the time of the second speed, the pressure oils from the first pump 131 and the second pump 132 are combined to each other and are introduced to the first hydraulic motor 135.

The hydraulic circuit includes the first direction control valve 141, the second direction control valve 142, a winch manipulating lever 213 (213F) which commands the driving of the winch, pilot valves 213*a* and 213*b* which generates a pilot pressure corresponding to a manipulated variable of the winch manipulating lever 213, and a motor capacity control unit 120. The hydraulic circuit includes a shuttle valve 218 which selects either a hoisting-side secondary pressure from the pilot valve 213*a* or a lowering-side secondary pressure from the pilot valve 213*b*.

The first direction control valve 141 controls the flow of the pressure oil from the first pump 131 to the hydraulic motor 135 and the second direction control valve 142 controls the flow of the pressure oil from the second pump 132 to the hydraulic motor 135. Each of the first direction control valve 141 and the second direction control valve 142 is a hydraulic pilot control type control valve which is controlled by a manipulation direction and the manipulated variable of the winch manipulating lever 213 (213F) provided in the above-described operator cab 109.

If the first direction control valve 141 is switched to a position A, the oil discharged from the first pump 131 is supplied to the hydraulic motor 135 via the main pipeline L2, and thus, the hydraulic motor 135 is rotated in a hoisting direction. If the first direction control valve 141 is switched to a position B, the oil discharged from the first pump 131 is supplied to the hydraulic motor 135 via the main pipeline L1, and thus, the hydraulic motor 135 is rotated in a lowering direction. If the second direction control valve 142 is switched to a position A, the oil discharged from the second pump 132 is supplied to the hydraulic motor 135 via the main pipeline L2, and thus, the hydraulic motor 135 is rotated in the hoisting direction. If the second direction control valve 142 is switched to a position B, the oil discharged from the second pump 132 is supplied to the hydraulic motor 135 via the main pipeline L1, and thus, the hydraulic motor 135 is rotated in a lowering direction.

If the winch manipulating lever 213 is manipulated in a hoisting direction (forward direction in FIG. 3) or a lowering direction (backward direction in FIG. 3), a secondary pressure (hereinafter, referred to as a pilot pressure) from pilot valves 213*a* and 213*b* is increased by an increase in the manipulated variable. The pilot pressure is introduced to a pilot portion of each of the first direction control valve 141 and the second direction control valve 142, and thus, the first direction control valve 141 and the second direction control valve 142 are switched.

A configuration of the motor capacity control unit 120 will be described. As shown in FIG. 5, the motor capacity control unit 120 includes a piston 121 which changes a motor displacement Qm, a first high-pressure selection valve 118 which selects a high pressure side of the discharge pressures of the first pump 131 and the second pump 132, a second high-pressure selection valve 119 which selects a high pressure side of the pressure oil from the first high-pressure selection valve 118 and the pressure oils from the pair of main pipelines L1 and L2 connected to the hydraulic motor 135 so as to introduces the high pressure-side pressure oil to oil chambers R1 and R2 of the piston 121, a control valve 123 which controls the flow of the pressure oil to the oil chamber R1, a solenoid proportional pressure-reducing valve 160 which decreases the pilot pressure from the shuttle valve 218 to the control valve 123 based on a command from the controller 150 described later, a cut-off valve 124, which cuts the flow of the pressure oil from the second high-pressure selection valve 119 to the control valve 123, an electromagnetic switching valve 125 described later, and a feedback mechanism 126.

A piston diameter in the oil chamber R1 is larger than a piston diameter in the oil chamber R2, and if each of the control valve 123 and the cut-off valve 124 is switched to an a position shown in FIG. 5, the piston 121 moves in an X2 direction shown in FIG. 5, and the motor displacement Qm (hereinafter, referred to as motor capacity Qm) decreases. Meanwhile, if the control valve 123 is switched to a c position and the pressure in the oil chamber R1 becomes a tank pressure, the piston 121 moves in an X1 direction, and the motor capacity Qm increases. Moreover, a change of the motor capacity Qm is fed back to the control valve 123 by the feedback mechanism 126 and serves as a servo mechanism.

The control valve 123 is switched according to the pilot pressure oil supplied via the solenoid proportional pressure-reducing valve 160. As shown in FIG. 5, a pilot pressure PL from the pilot valve 213*a* or the pilot valve 213*b* is introduced to the solenoid proportional pressure-reducing valve 160 via the shuttle valve 218, and the pressure oil whose pressure is decreased by the solenoid proportional pressure-reducing valve 160 is introduced to the control valve 123.

In a state where a fuel-saving operation mode condition described later is satisfied (that is, a performance standby state of the fuel-saving operation mode), if the winch manipulating lever 213 is manipulated from a hoisting first-speed detent position toward a hoisting second-speed detent position or a lowering first-speed detent position toward a lowering second-speed detent position, the fuel-saving operation mode is performed. Accordingly, a maximum current is output from the controller 150 to the solenoid proportional pressure-reducing valve 160 as a control current. If the winch manipulating lever 213 is full-manipulated, a maximum pilot pressure is output from the pilot valves 213*a* and 213*b*, the maximum pilot pressure is applied to the control valve 123 without being decreased by the solenoid proportional pressure-reducing valve 160, and the control valve 123 is switched to the a position. If the control valve 123 is switched to the a position, the pressure oil from the second high-pressure selection valve 119 is introduced to the oil chamber R1, the piston 121 moves in the X2 direction, and thus, the motor displacement decreases. A decrease amount of the motor displacement is fed back to the control valve 123 by the feedback mechanism. 126, the control valve 123 is switched to the b position in a state where the motor capacity Qm is a minimum capacity Qm3 (refer to FIG. 8), and the motor displacement is stabilized.

The cut-off valve 124 is switched according to the pressure of the pressure oil from the second high-pressure selection valve 119. If the pressure from the second high-pressure selection valve 119 is smaller than a cut-off pressure Pc, the cut-off valve 124 is switched to the a position, and the supply of the pressure oil from second high-pressure selection valve 119 to the oil chamber R1 is allowed. If the pressure from the second high-pressure selection valve 119 is the same as the cut-off pressure Pc, the cut-off valve 124 is switched to the b position, and the supply of the pressure oil to the oil chamber R1 is prohibited, and thus, a decrease of the motor displacement is prevented. If the pressure from the second high-pressure selection valve 119 is larger than the cut-off pressure Pc, the cut-off valve 124 is switched to the c position, the pressure oil of the oil chamber R1 is returned to the hydraulic oil tank 133, and thus, the motor displacement increases.

A spring 124*a* for setting the cut-off pressure is provided in the cut-off valve 124, and the cut-off pressure Pc is set to a predetermined pressure by a biasing force of the spring 124*a*.

Accordingly, in the present embodiment, the cut-off valve 124 is provided in the hydraulic circuit, and thus, the motor capacity Qm is limited according to a circuit pressure of the hydraulic motor 135. Therefore, when the suspended load 106*a* is lowered, if the circuit pressure increases and exceeds the cut off pressure Pc, the cut-off valve 124 is operated. Accordingly, the motor capacity Qm increases to the maximum capacity Qm1, and an excessive rotation of the hydraulic motor 135 is prevented.

Figure 6:
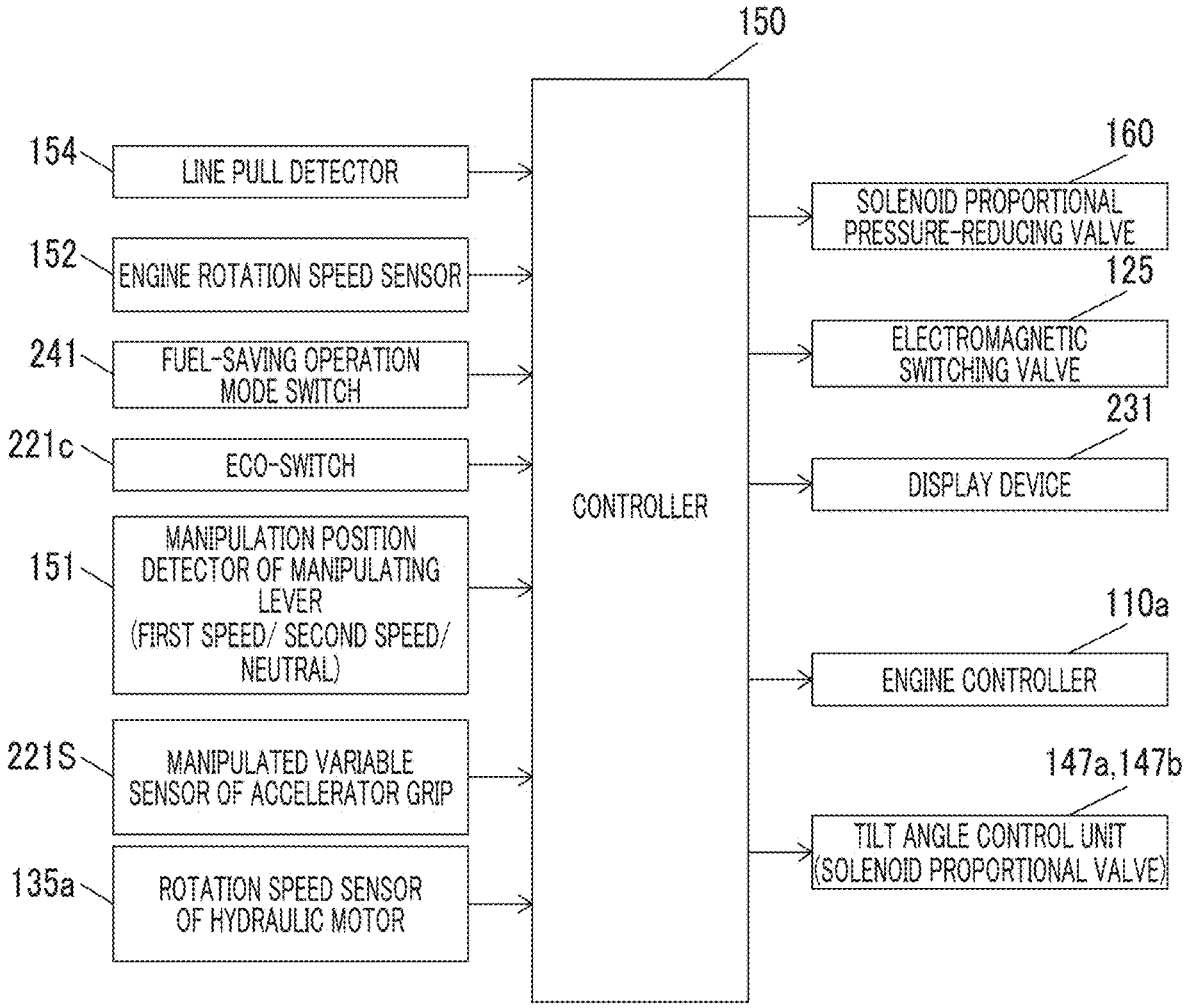
FIG. 6 is a block diagram showing a configuration of a control device of the winch.

Next, an electric configuration of the control device of the winch will be described. FIG. 6 is a block diagram showing a configuration of the control device of the winch. The controller 150 is a control device for controlling respective portions of the crane 1, and includes a CPU for performing various calculations, a memory which is a storage unit, other peripheral units, or the like. An engine controller 110*a* is connected to the controller 150. The engine controller 110*a* is a control device which controls the engine 110 such as starting the engine 110, operating the engine 110 at a predetermined rotation speed, or stopping the engine 110, and includes a CPU for performing various calculations, a memory which is a storage unit, other peripheral units, or the like. In addition, the controller 150 and the engine controller 110*a* configure an engine control unit of the present invention.

A manipulation position detector 151 which detects the manipulation position (manipulated variable) of the winch manipulating lever 213, an engine rotation speed sensor 152 which measures an actual rotation speed Na of the engine 110, a hydraulic motor rotation speed sensor 135*a* which measures the rotation speed of the hydraulic motor 135, a manipulated variable sensor 221S which measures the manipulated variable of the accelerator grip 221*a*, the fuel-saving operation mode switch 241, the eco-switch 221*c*, the line pull detector 154, the solenoid proportional pressure-reducing valve 160, the electromagnetic switching valve 125, the display device 231, and the solenoid proportional valve which constitutes the tilt angle control units 147*a* and 147*b* are connected to the controller 150.

The manipulation position detector 151 can be configured of a pressure sensor (not shown in FIG. 5) which measures the pilot pressure output from the pilot valves 213*a* and 213*b*. Instead of the pilot pressure sensor, the manipulation position detector 151 may be configured of a stroke sensor which measures a lever stroke.

The controller 150 sets a target rotation speed Nt of the engine 110 corresponding to the manipulated variable of the accelerator grip 221*a* measured by the manipulated variable sensor 221S of the accelerator grip 221*a*, outputs a target rotation speed command to the engine controller 110*a*, and controls the actual rotation speed Na of the engine 110. In addition, though it will be described in detail later, the controller 150 sets the upper limit value of the rotation speed of the engine 110 corresponding to a line pull value detected by the line pull detector 154 while operating in the fuel-saving operation mode, and outputs a limit command for limiting the upper limit value of the rotation speed of the engine 110 to the engine controller 110*a*. The engine controller 110*a* controls the upper limit of the rotation speed of the engine 110 according to the limit command.

The engine controller 110*a* compares the actual rotation speed Na of the engine 110 measured by the engine rotation speed sensor 152 and the target rotation speed Nt of the engine 110 from the controller 150 and controls a fuel injection device (not shown) such that the actual rotation speed Na of the engine 110 approaches the target rotation speed Nt. That is, the engine controller 110*a* controls the actual rotation speed Na of the engine 110 in a range from a minimum rotation speed Nmin to a maximum rotation speed Nmax according to a manipulated variable Sg of the accelerator grip 221*a* measured by the manipulated variable sensor 221S of the accelerator grip 221*a*.

The fuel-saving operation mode switch 241 is a mode change-over switch which selectively switches the mode to a limit mode in which the motor capacity Qm of the hydraulic motor 135 is controlled to a minimum capacity Qm3 when a fuel-saving operation mode condition described later is satisfied and a non-limit mode in which the motor capacity Qm of the hydraulic motor 135 is not controlled to the minimum capacity Qm3 when the fuel-saving operation mode condition is satisfied.

The controller 150 outputs a predetermined control current to the solenoid proportional pressure-reducing valve 160 according to the manipulation position of the winch manipulating lever 213 detected by the manipulation position detector 151. In a state where the fuel-saving operation mode condition described later is not satisfied, the controller 150 outputs a control current I=I2 (I2<Imax) when the winch manipulating lever 213 is manipulated to the second-speed detent position and outputs the control current I=I1 (I1<I2) when the winch manipulating lever 213 is manipulated to the first-speed detent position. If the fuel-saving operation mode condition described later is satisfied, the controller 150 outputs the control current I=Imax.

When the fuel-saving operation mode switch 241 is turned on, the controller 150 output a control signal corresponding to the manipulated variable of the winch manipulating lever 213 to the tilt angle control units 147*a* and 147*b* respectively provided in the first pump 131 and the second pump 132. The discharge amounts of the first pump 131 and the second pump 132 increase according to the increase in the manipulated variable of the winch manipulating lever 213.

The eco-switch 221*c* is a change-over switch which causes the limit mode selected by the fuel-saving operation mode switch 241 to be effective or ineffective. The display device 231 displays a display screen of "ECO" when the fuel-saving operation mode switch 241 is turned on and highlights the display screen of "ECO" if the fuel-saving operation mode condition described later is satisfied.

For example, the line pull detector 154 is a pin type load cell and detects a line pull T of the rope which is applied to the winch drum by the line pull detector 154.

In the crane 1 of the present embodiment, if conditions of the following (a) and (b) are satisfied, the controller 150 determines that the fuel-saving operation mode condition is satisfied.

(a) It is detected that the fuel-saving operation mode switch 241 is positioned at ON position.

(b) It is detected that the eco-switch 221*c* is positioned at ON position.

If the fuel-saving operation mode condition is satisfied, the crane 1 enters a second-speed manipulation standby state where the winch is hoisted/lowered at a high speed. In this state, if the winch manipulating lever 213 is manipulated from the hoisting/lowering manipulation position on the low speed (first speed) side toward the hoisting/lowering manipulation position on a high speed (second speed) side, the controller 150 shifts the mode to the fuel-saving operation mode. In addition, the controller 150 controls the motor capacity control unit 120 so as to decrease the motor capacity Qm (motor displacement) of the hydraulic motor 135, and thus, the motor capacity becomes the minimum capacity Qm3. In addition, the controller 150 controls the tilt angle control units 147*a* and 147*b* so as to increase the pump capacities Qp of the first pump 131 and the second pump 132, and thus, the motor capacity becomes the maximum capacity Qp3. Accordingly, the hydraulic motor 135 can be brought into a third-speed state in which the hydraulic motor 135 can be driven at a speed higher than the speed of the second-speed state. In the third-speed state, when the engine rotation speed is a predetermined upper limit rotation speed, the winch drum is rotated to a hoisting side or a lowering side at a speed higher than the speed of the second-speed state.

In addition, if the mode is shifted to the fuel-saving operation mode, the controller 150 sets the upper limit value of the rotation speed of the engine 110 to a value corresponding to the line pull value and an upper limit command of the engine rotation speed to the engine controller 110*a*. Accordingly, the engine controller 110*a* can drive the engine 110 to the upper limit of the rotation speed of the engine 110 corresponding to the line pull value.

Figures 7, 8:
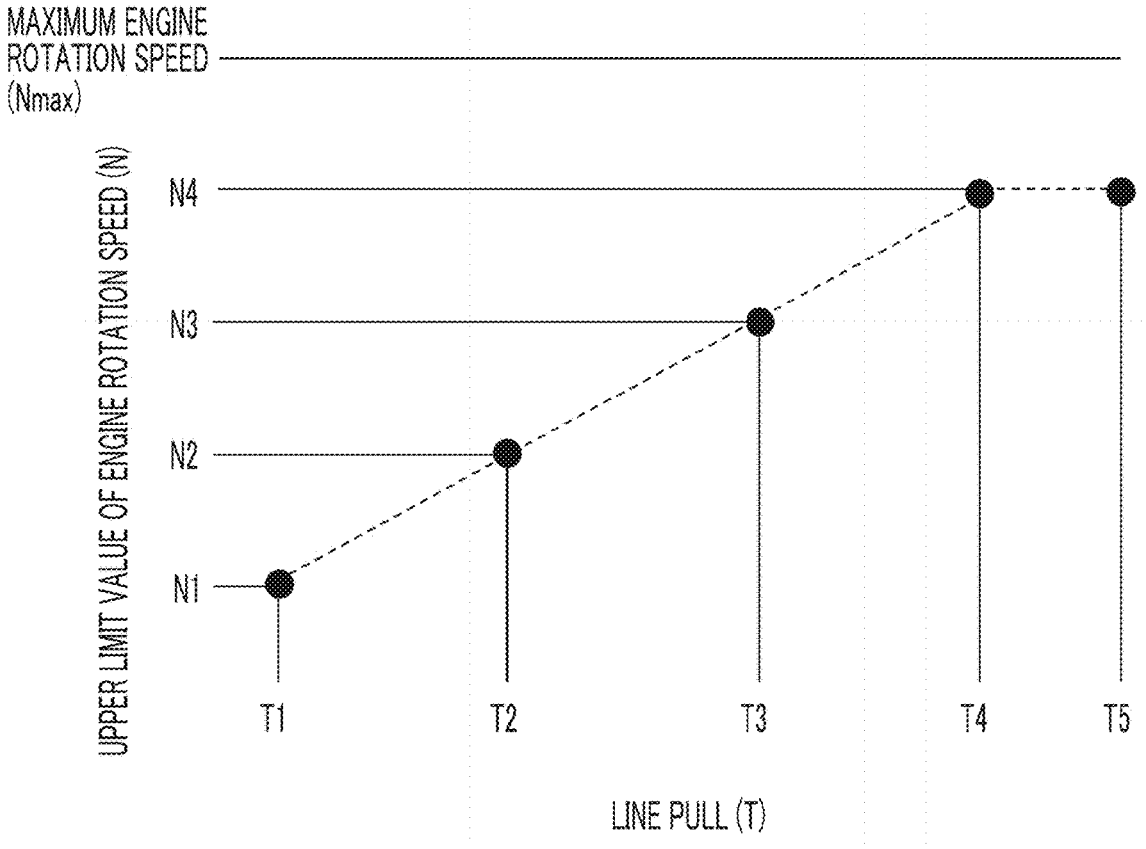
FIG. 7 is a diagram showing a relationship between a line pull value and an upper limit value of a rotation speed of an engine.
FIG. 8 is a diagram showing usage ranges of a motor capacity and a pump capacity in a normal operation mode and a fuel-saving operation mode.

The line pull value and the upper limit value of the rotation speed of the engine 110 will be described in detail. FIG. 7 is a diagram showing a relationship between the line pull value and the upper limit value of the rotation speed of the engine. As shown in FIG. 7, in a range from the line pull values T1 to T4, the relationship between the line pull value and the engine rotation speed has a linear characteristic. In addition, the upper limit value of the engine rotation speed increases to N1 to N4 at the same inclination as the line pull value increases, and in a range in which the line pull value is T4 to T5, the upper limit value of the engine rotation speed is constant at N4. This characteristic is stored in a storage unit of the controller 150 as a table, and if the line pull value of the hanging rope 104 detected by the line pull detector 154 is input to the controller 150, the controller 150 obtains the upper limit value of the rotation speed of the engine 110 corresponding to the line pull value and outputs the limit command of the upper limit value to the engine controller 110*a*. Moreover, the upper limit value N4 of the engine rotation speed is set to the same value as the rotation speed at a minimum fuel consumption rate point of the engine 110. Accordingly, when the engine rotation speed is N4, an optimal fuel-saving operation can be performed.

FIG. 8 is a diagram showing usage ranges of the motor capacity and the pump capacity in the normal operation mode and the fuel-saving operation mode. As shown in FIG. 8, in the normal operation mode, the usage range of the motor capacity Qm of the hydraulic motor 135 is Qm1 to Qm2 (here, Qm1>Qm2), and the usage range of the pump capacity Qp of each of the first pump 131 and the second pump 132 is Qp1 to Qp2 (here, Qp1>Qp2). Meanwhile, in the fuel-saving operation mode, the usage range of the motor capacity Qm of the hydraulic motor 135 is Qm1 to Qm3 (here, Qm2>Qm3), and the usage range of the pump capacity Qp of each of the first pump 131 and the second pump 132 is Qp3 to Qp1 (here, Qp3>Qp1). That is, a lower limit of the motor capacity Qm in the fuel-saving operation mode is a value which is smaller than a lower limit thereof in the normal operation mode, and an upper limit of the pump capacity Qp in the fuel-saving operation mode is a value which is larger than an upper limit thereof in the normal operation mode. Accordingly, in the fuel-saving operation mode, the engine rotation speed decreases, the motor capacity Qm is set to the minimum capacity Qm3, the pump capacity Qp is set to the maximum capacity Qp3, and thus, it is possible to rotate the winch drum at a high speed.

Figure 9:
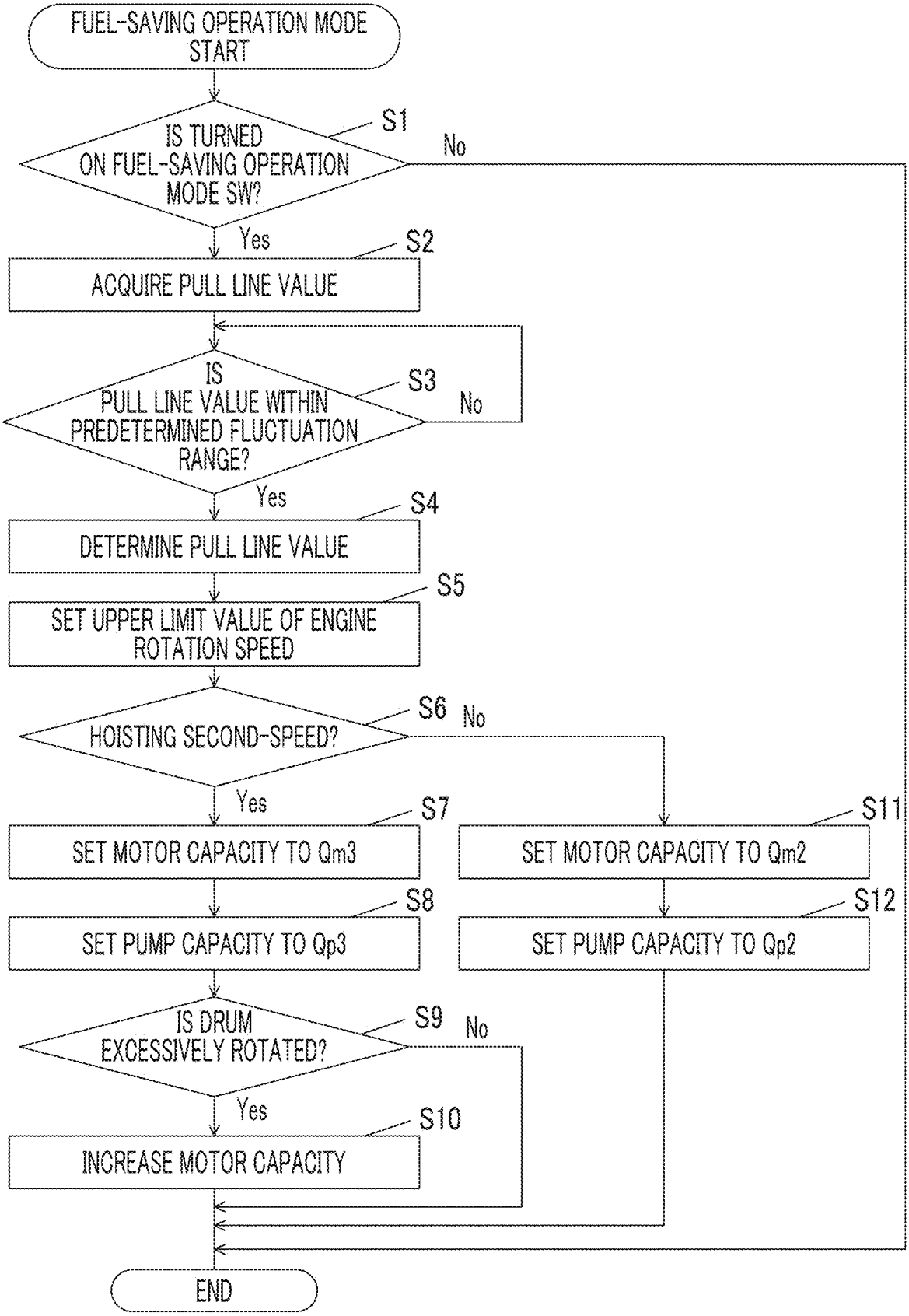
FIG. 9 is a flowchart showing a procedure of the fuel-saving operation mode performed by a controller.

FIG. 9 is a flowchart showing a procedure of the fuel-saving operation mode performed by the controller 150. If the fuel-saving operation mode is performed, the controller 150 determines whether or not the fuel-saving operation mode switch 241 is turned on (S1). In a case where the fuel-saving operation mode switch 241 is turned off (S1/No), the processing ends, and in a case where the fuel-saving operation mode switch 241 is turned on (S1/Yes), the line pull value is acquired (S2). In a case where the line pull value is within a predetermined fluctuation range, the controller 150 assumes that the load 106*a* suspended by the main hook 106 is separated from the ground (it is assumed that a ground cutting work is completed), the controller 150 determines the line pull value (S4). Next, the controller 150 sets the upper limit value of the engine rotation speed corresponding to the line pull value with reference to the table defining the relationship between the line pull value and the upper limit of the engine rotation speed shown in FIG. 7 (S5). For example, in a case where the line pull value is T3, as shown in FIG. 7, the controller 150 sets the upper limit value of the engine rotation speed to N3.

Next, the controller 150 determines whether or not the winch manipulating lever 213 is manipulated toward the hoisting/lowering manipulation position on the high speed (second speed) side (S6). In a case where the winch manipulating lever 213 is manipulated toward the hoisting/lowering manipulation position on the high speed (second speed) side (S6/Yes), the controller 150 sets the motor capacity to Qm3 (S7) and sets the pump capacity to Qp3 (S8).

Next, the controller 150 determines whether or not the winch drum (front drum 105*a*) is excessively rotated (S9). Specifically, the controller 150 determines whether or not the rotation speed of the hydraulic motor 135 exceeds a rotation speed of a predetermined drum based on a detection signal from the hydraulic motor rotation speed sensor 135*a* measuring the rotation speed of the hydraulic motor 135, and thus, presence or absence of the excessive rotation of the winch drum is determined. In a case where it is determined that the winch drum is excessively rotated (S9/Yes), the controller 150 increases the motor capacity (S10), and the processing ends. Meanwhile, in a case where the winch manipulating lever 213 is not manipulated toward the hoisting/lowering manipulation position on the high speed (second speed) side (S6/No), the controller 150 sets the motor capacity to Qm2 (S11) and sets the pump capacity to Qp2 (S12), and the processing ends.

Figure 10:
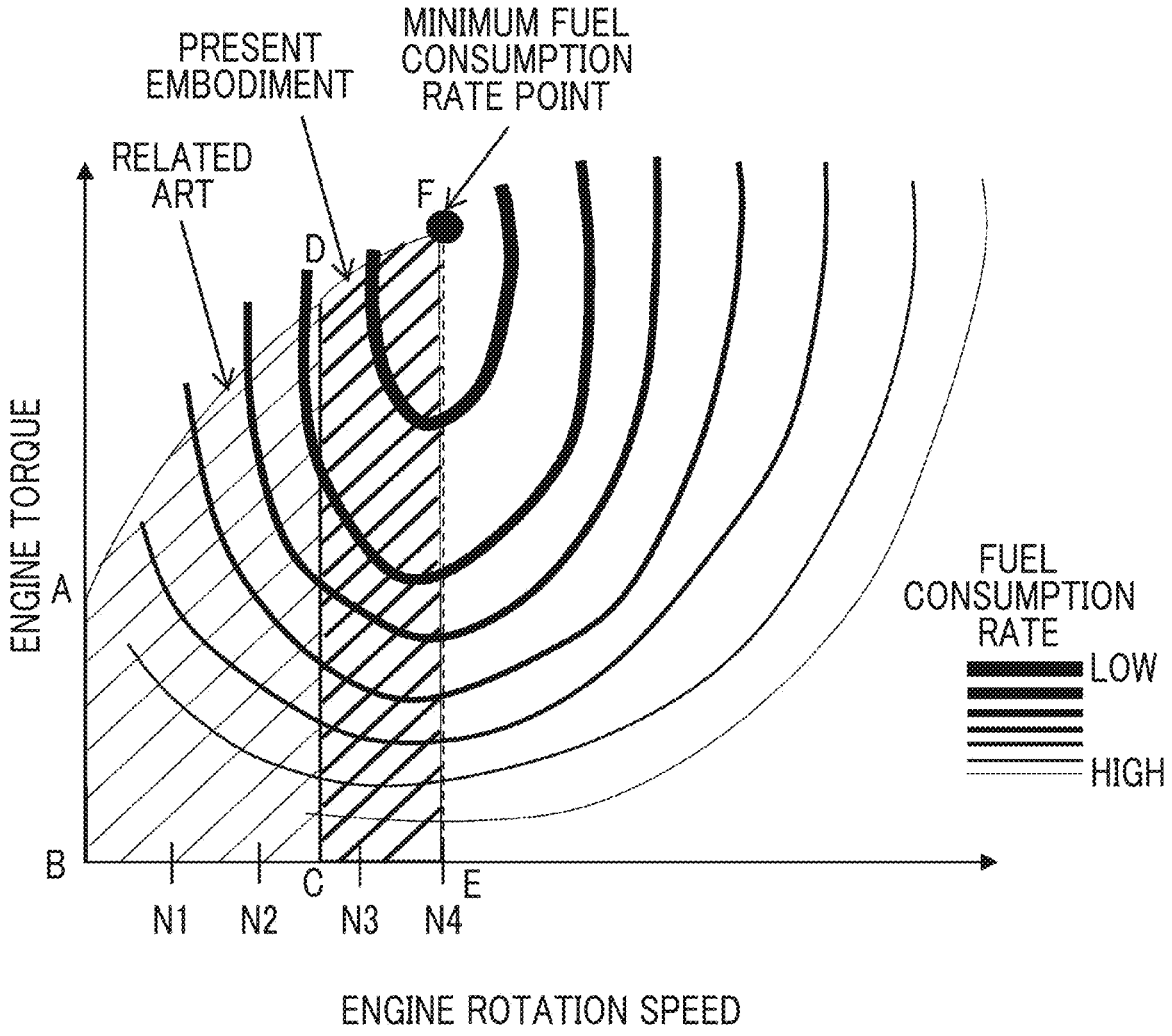
FIG. 10 is a diagram showing a relationship between an engine rotation speed, an engine torque, and a fuel consumption rate.

Next, effects of the present embodiment will be described in comparison with those of the related art. FIG. 10 is a diagram showing a relationship between the engine rotation speed, an engine torque, and the fuel consumption rate. As shown in FIG. 10, in the related art, the upper limit value of the engine rotation speed in the fuel-saving operation mode is fixed to one value (for example, a value between N2 and N3), and thus, the engine 110 can be driven in only a hatched region surrounded by ABCD in FIG. 10. Meanwhile, in the present embodiment, the upper limit value of the engine rotation speed can be changed in a range of N1 to N4 according to the line pull value, and thus, a use region of the engine 110 in the fuel-saving operation mode can be extended to a region obtained by adding a hatched region surrounded by DCEF to the hatched region surrounded by ABCD in FIG. 10. As a result, since the engine 110 can be driven on an improved line of the fuel consumption rate, it is possible to further improve the fuel consumption of the engine 110 in the fuel-saving operation mode, as compared with the related art.

OTHER EMBODIMENTS

It should be understood that the invention is not limited to the above-described embodiment, but may be modified into various forms on the basis of the spirit of the invention. Additionally, the modifications are included in the scope of the invention.

Figure 11:
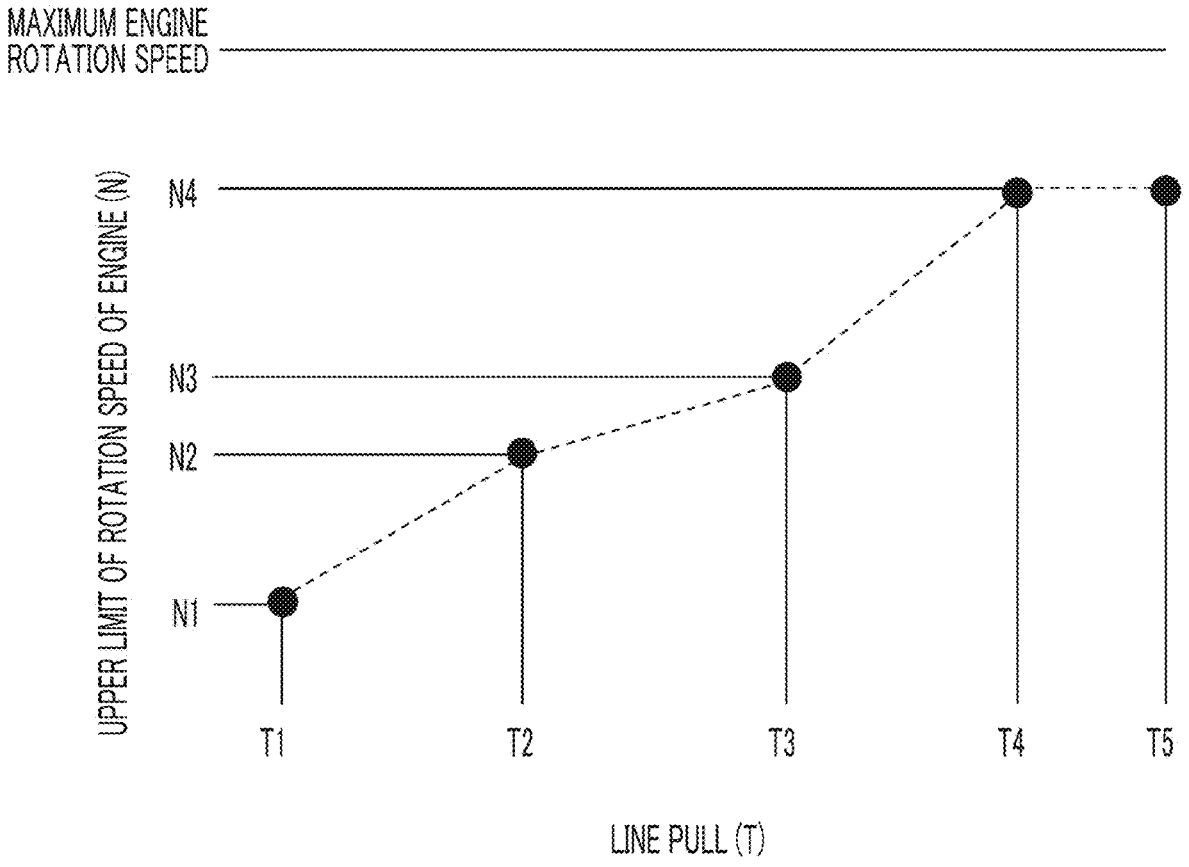
FIG. 11 is a diagram showing a relationship between a line pull value and an upper limit value of a rotation speed of an engine according to Modification Example 1.

For example, the upper limit value of the rotation speed of the engine 110 with respect to the line pull value may be installed based on characteristics in which the upper limit value increases at a different inclination. FIG. 11 is a diagram showing a relationship between a line pull value and an upper limit value of a rotation speed of an engine according to Modification Example 1. As shown in FIG. 11, Modification Example 1 has characteristics in which the upper limit value of the engine rotation speed with respect to the line pull value increases at different inclinations in a range in which the line pull value is T1 to T2, a range in which the line pull value is T2 to T3, and a range in which the line pull value is T3 to T4. According to the characteristics, the engine rotation speed can be set to a more suitable upper limit value according to the line pull value, and thus, it is possible to drive the engine 110 at a lower operating point of the fuel consumption rate and further improve the fuel consumption.

Figure 12:
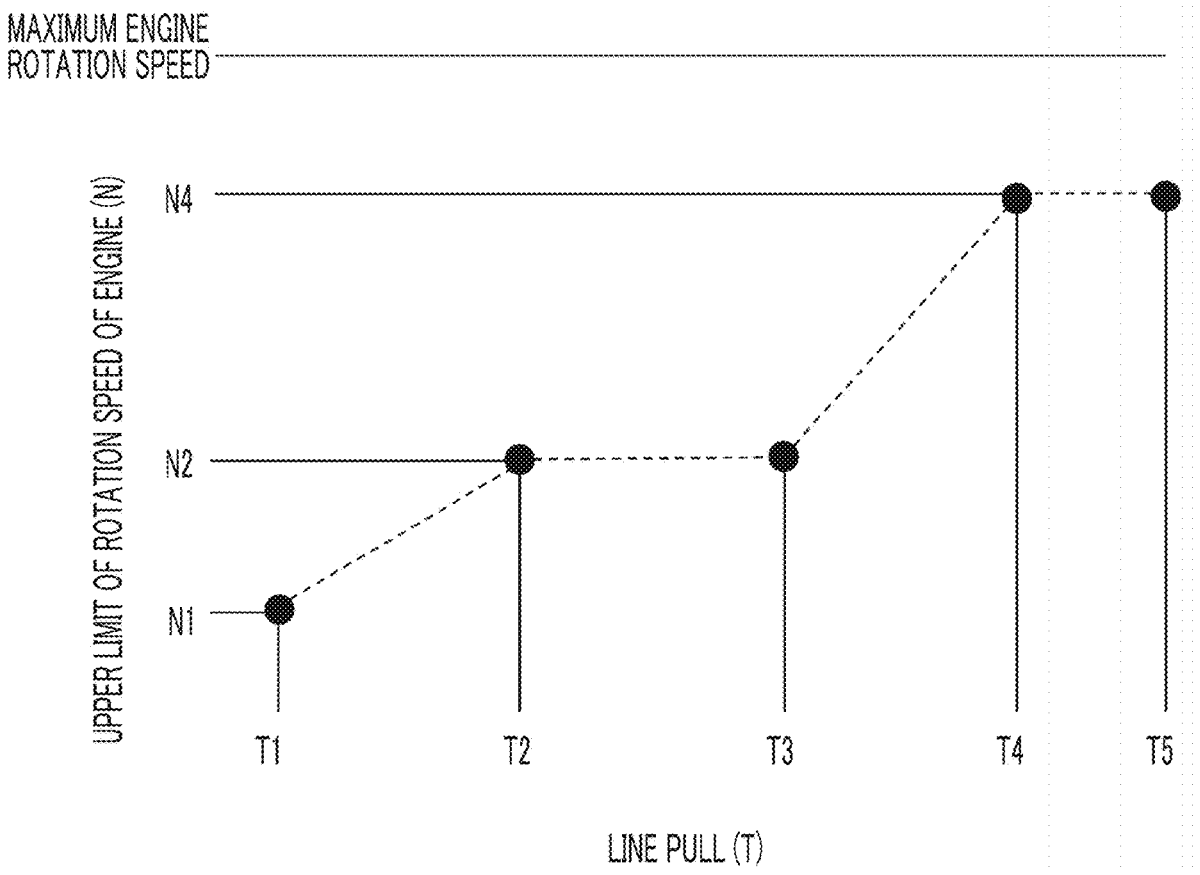
FIG. 12 is a diagram showing a relationship between a line pull value and an upper limit value of a rotation speed of an engine according to Modification Example 2.

In addition, FIG. 12 is a diagram showing a relationship between a line pull value and an upper limit value of a rotation speed of an engine according to Modification Example 2. As shown in FIG. 12, Modification Example 2 has characteristics in which the upper limit value of the engine rotation speed with respect to the line pull value increases at different inclinations in a range in which the line pull value is T1 to T2 and a range in which the line pull value is T3 to T4, and has characteristics in which the engine rotation speed is constant with respect to the value of the line pull value in a range in which the line pull value is T2 to T3. According to the characteristics, the engine rotation speed can be set to a suitable upper limit value according to the line pull value, and thus, it is possible to further improve the fuel consumption.

In addition, the characteristics can be appropriately changed, and for example, the characteristics may be changed such that the upper limit value of the engine rotation speed increases stepwise as the line pull value increases. Alternatively, the upper limit value of the engine rotation speed with respect to the line pull value may be determined according to nonlinear characteristics.

In addition, in the present embodiment, as shown in FIG. 9, the fuel-saving operation mode is performed by setting the motor capacity Qm to the minimum capacity Qm3 in Step S7 and setting the pump capacity Qp to the maximum capacity Qp3 in Step S8. However, one of the motor capacity Qm and the pump capacity Qp may be controlled. That is, the processing of one of Step S7 and Step S8 in FIG. 9 may be omitted. Even when one processing is omitted, it is possible to improve the fuel consumption in the fuel-saving operation mode.

In addition, in the above-described embodiment, the line pull detector 154 is used as the winch load detector. However, instead of this, for example, the line pull value may be estimated from the number of drum layers, the motor capacity of the hydraulic motor 135, and a motor winding pressure of the hydraulic motor 135. In addition, in the present invention, in addition to directly detecting the load applied to the winch drum, for example, fluctuations of the load applied to the winch drum may be detected such that the upper limit value of the engine rotation speed in the fuel-saving operation mode is set based on the fluctuations of the load. That is, in the present invention, the winch load detector not only detects the load applied to the winch drum but also indirectly detects the load. Moreover, the present invention can be applied to the control devices of all the winch drums mounted on the crane, that is, the control devices of the front drum 105*a*, the rear drum 105*b*, and the boom derricking drum 107.

What is claimed is:

1. A control device of a hydraulic winch which has a normal operation mode and a fuel-saving operation mode in which a fuel-saving operation is performed unlike in the normal operation mode, is applied to a crane for hoisting/lowering a rope by a winch drum, and controls a rotation of the winch drum, the device comprising:

an engine;

a variable capacity hydraulic pump which is driven by the engine;

a variable capacity hydraulic motor which is rotated by pressure oil from the hydraulic pump to drive the winch drum;

a winch manipulating member configured to output hoisting/lowering commands for hoisting/lowering the rope;

an engine control unit configured to control a rotation speed of the engine to be in a range from a minimum rotation speed to a maximum rotation speed according to the hoisting/lowering commands from the winch manipulating member;

a winch load detector configured to detect a load applied to the winch drum; and a motor capacity control unit configured to control a motor capacity of the hydraulic motor so as to decrease a motor capacity of the hydraulic motor in the fuel-saving operation mode to a motor capacity which is smaller than a motor capacity of the hydraulic motor in the normal operation mode, wherein the engine control unit sets an upper limit value of the rotation speed of the engine in the fuel-saving operation mode to a value which is lower than the maximum rotation speed of the engine in the normal operation mode and corresponds to the load detected by the winch load detector.

2. The control device of a hydraulic winch according to claim 1, further comprising:

a pump capacity control unit configured to control a pump capacity of the hydraulic pump such that a pump capacity of the hydraulic pump in the fuel-saving operation mode increases to a pump capacity which is larger than a pump capacity of the hydraulic pump in the normal operation mode.

3. The control device of a hydraulic winch according to claim 1, wherein the upper limit value of the rotation speed of the engine is predetermined such that the load detected by the winch load detector increases at a constant inclination in a predetermined range as the load detected by the winch load detector increases.

4. The control device of a hydraulic winch according to claim 1, wherein the upper limit value of the rotation speed of the engine is predetermined such that the load detected by the winch load detector increases at a different inclination in a predetermined range as the load detected by the winch load detector increases.

5. The control device of a hydraulic winch according to any one of claim 1, wherein the engine control unit sets the upper limit value of the rotation speed of the engine using the load detected by the winch load detector when a load hung by the rope is away from a ground.

6. The control device of a hydraulic winch according to any one of claim 1, wherein the winch load detector is a line pull detector which detects a line pull of the rope.

7. A control device of a hydraulic winch which has a normal operation mode and a fuel-saving operation mode in which a fuel-saving operation is performed unlike in the normal operation mode, is applied to a crane for hoisting/lowering a rope by a winch drum, and controls a rotation of the winch drum, the device comprising:

an engine;

a variable capacity hydraulic pump which is driven by the engine;

a variable capacity hydraulic motor which is rotated by pressure oil from the hydraulic pump to drive the winch drum;

a winch manipulating member configured to output hoisting/lowering commands for hoisting/lowering the rope;

an engine control unit configured to control a rotation speed of the engine to be in a range from a minimum rotation speed to a maximum rotation speed according to the hoisting/lowering commands from the winch manipulating member;

a winch load detector configured to detect a load applied to the winch drum; and a pump capacity control unit configured to control a pump capacity of the hydraulic pump so as to increase a pump capacity of the hydraulic pump in the fuel-saving operation mode to a pump capacity which is larger than a pump capacity of the hydraulic pump in the normal operation mode, wherein the engine control unit sets an upper limit value of the rotation speed of the engine in the fuel-saving operation mode to a value which is lower than the maximum rotation speed of the engine in the normal operation mode and corresponds to the load detected by the winch load detector.

* * * * *